US007164751B2

(12) United States Patent
Weil

(10) Patent No.: US 7,164,751 B2
(45) Date of Patent: Jan. 16, 2007

(54) DEVICE FOR GENERATING X-RAYS

(75) Inventor: Lothar Weil, Hamburg (DE)

(73) Assignee: Koninklijke Philips Electronics, N.V., Eindoven (NL)

( * ) Notice: Subject to any disclaimer, the term of this patent is extended or adjusted under 35 U.S.C. 154(b) by 323 days.

(21) Appl. No.: 10/503,959

(22) PCT Filed: Jan. 27, 2003

(86) PCT No.: PCT/IB03/00241

§ 371 (c)(1),
(2), (4) Date: Aug. 9, 2004

(87) PCT Pub. No.: WO03/069650

PCT Pub. Date: Aug. 21, 2003

(65) Prior Publication Data

US 2006/0256923 A1 Nov. 16, 2006

(30) Foreign Application Priority Data

Feb. 11, 2002 (EP) ..... 02075553

(51) Int. Cl.
*H01J 35/00* (2006.01)

(52) U.S. Cl. ..... 378/127; 378/132; 378/144

(58) Field of Classification Search ..... 378/119, 378/121, 125, 127, 132, 133, 143, 144
See application file for complete search history.

(56) References Cited

U.S. PATENT DOCUMENTS

| | | | | |
|---|---|---|---|---|
| 2,075,146 | A | 3/1937 | Sergeeff | 378/123 |
| 3,711,736 | A | 1/1973 | Gabbay | 378/130 |
| 4,165,472 | A | 8/1979 | Wittry | 378/127 |
| 4,928,296 | A | 5/1990 | Kadambi | 378/141 |
| 4,949,369 | A | 8/1990 | Bittl | 378/130 |
| 5,077,775 | A | 12/1991 | Vetter | 378/132 |
| 6,304,631 | B1 | 10/2001 | Snyder | 378/130 |

FOREIGN PATENT DOCUMENTS

DE 29 21 303 12/1980

*Primary Examiner*—Courtney Thomas

(57) ABSTRACT

The present invention relates to a device for generating X-rays having a source for emitting electrons, a carrier which is provided with a material which generates X-rays as a result of the incidence of electrons, and a bearing by means of which the carrier is journalled so as to be rotatable about an axis of rotation, the device further having a chamber that is bounded by a heat transferring surface of the carrier and by a heat transferring surface of the first bearing member, and that is at least partially filled with a heat transferring material, the material being urged, during operation, towards both heat transferring surfaces so that a relatively high rate of heat transfer is obtained between the heat transferring surfaces and the transferring material, which is not affected when the transferring surfaces thermally deform at relatively high temperatures because the transferring material will follow deformations of the heat tranferring surfaces such that the reduction of the overall rate of heat transfer is limited.

9 Claims, 6 Drawing Sheets

DEVICE FOR GENERATING X-RAYS

Figure 1:
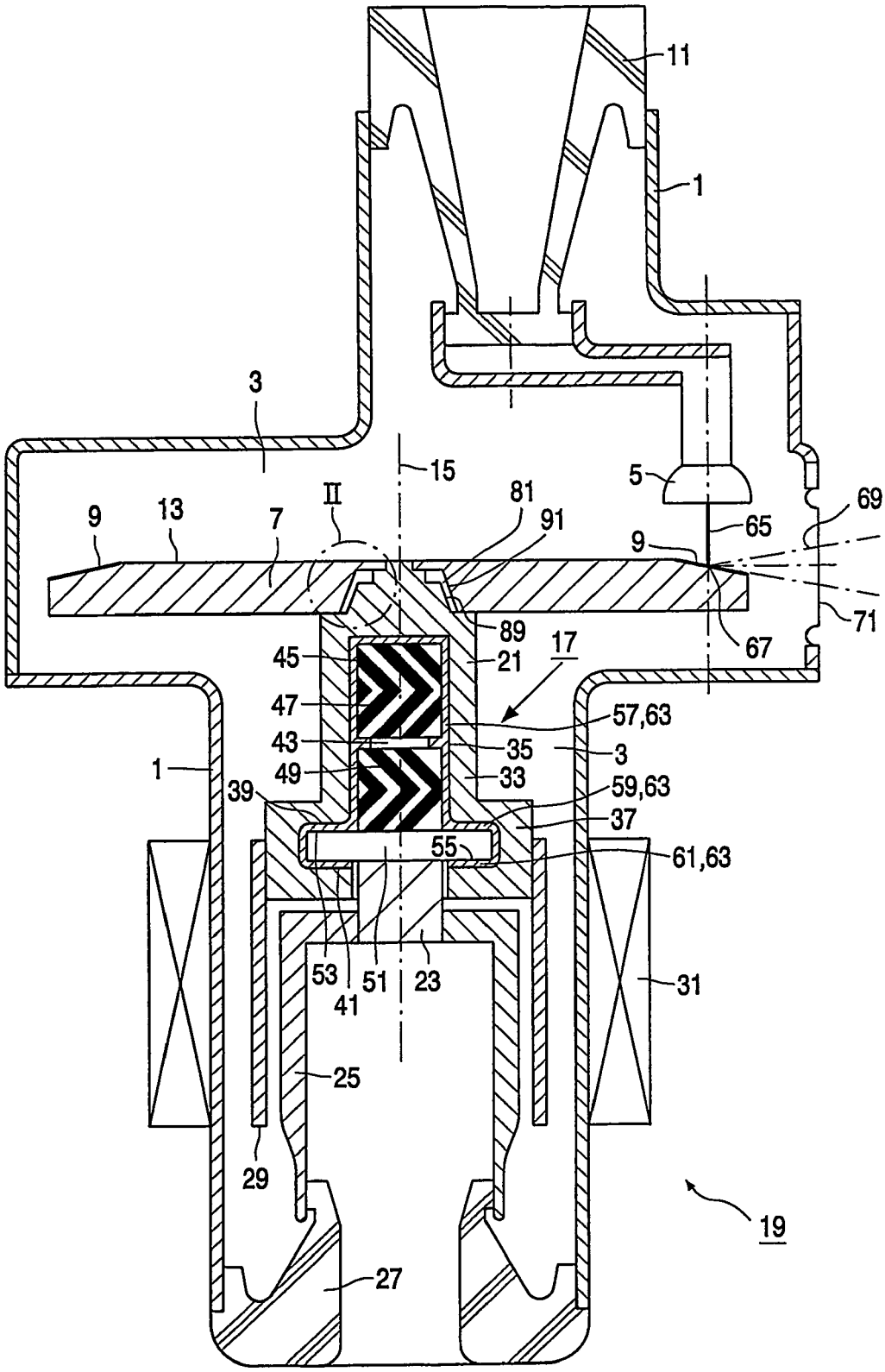

The invention relates to a device for generating X-rays, which device comprises a source for emitting electrons, a carrier which is provided with a material which generates X-rays as a result of the incidence of electrons, and a bearing having an internal bearing member and an external bearing member by means of which the carrier is journalled so as to be rotatable about an axis of rotation, a first one of the bearing members being connected to the carrier.

A device of the kind mentioned in the opening paragraph is known from U.S. Pat. No. 5,077,775. The source, the carrier, and the bearing of the known device are accommodated in a vacuum space. The carrier is disc-shaped and is mounted to the external bearing member. During operation, an electron beam generated by the source impinges upon the X-ray generating material of the carrier in an impingement position near the circumference of the carrier. As a result, X-rays are generated in said impingement position, which emanate through an X-ray exit window provided in a housing enclosing the vacuum space. The carrier is rotated about the axis of rotation, so that the impingement position follows a circular path relative to the carrier. As a result, the heat, which is generated in the impingement position as a result of the incidence of the electrons, is evenly distributed along said circular path and over the entire carrier, so that the carrier is evenly warmed up. Since the carrier is present in the vacuum space, heat transfer from the carrier to the surroundings of the device mainly takes place by heat conduction via the carrier and the bearing members. Only a comparatively small amount of heat is transferred away from the carrier by heat radiation.

In the known device, the bearing is a dynamic groove bearing having an annular bearing gap between the internal bearing member and the external bearing member. Said bearing gap extends over a relatively large distance in the axial direction and is filled with a liquid metal lubricant. As a result, the bearing as such has a relatively large heat transfer capacity by heat conduction via the lubricant in the bearing gap. In the known device, however, the heat transfer capacity of the bearing is not optimally utilized, because the rate of heat transfer from the carrier to the surroundings via the bearing is limited by the fact that the carrier and the external bearing member, to which the carrier is mounted, form separate parts of the device, so that an interruption of the heat transfer path is present at the location of the mounting surfaces where these parts contact each other. At relatively high temperatures of the carrier, i.e. at relatively high energy levels of the generated X-rays, thermal deformation of said mounting surfaces occurs, as a result of which the thermal contact between these parts deteriorates and the rate of heat transfer between these parts is further reduced.

An object of the invention is to provide a device for generating X-rays of the kind mentioned in the opening paragraph, in which the rate of heat transfer via the bearing is improved and in which a reduction of said rate of heat transfer at relatively high temperatures of the carrier is prevented as much as possible.

In order to achieve said object, a device for generating X-rays according to the invention is characterized in that the device comprises a chamber which is bounded by a heat transferring surface of the carrier and by a heat transferring surface of the first bearing member, and which is at least partially filled with a heat transferring material, which is liquid at an operational temperature of the device, said liquid material being urged, during operation, towards both said heat transferring surfaces. As a result, during operation an additional heat transfer path is present between the carrier and the first bearing member, which additional heat transfer path includes the carrier, the heat transferring surface of the carrier, the liquid heat transferring material, the heat transferring surface of the first bearing member, and the first bearing member. Said additional heat transfer path is parallel to the heat transfer path which goes directly from the carrier to the first bearing member via the location where the first bearing member is connected to the carrier. As a result, the overall rate of heat transfer from the carrier to the first bearing member, and further to the surroundings of the device via the bearing, is considerably increased. Since, during operation at the operational temperature of the device, the heat transferring material is liquid and is urged towards both the heat transferring surface of the carrier and the heat transferring surface of the first bearing member, a good thermal contact and, accordingly, a relatively high rate of heat transfer is obtained between said heat transferring surfaces and the liquid heat transferring material. Said thermal contact is not affected when the carrier and the first bearing member, and hence said heat transferring surfaces, thermally deform at relatively high temperatures, because the liquid heat transferring material will follow deformations of the heat transferring surfaces. As a result, the relatively high rate of heat transfer via the additional heat transfer path is maintained at high temperatures, so that the reduction of the overall rate of heat transfer is limited. The device according to the invention is provided with suitable urging means to urge the liquid heat transferring material towards said heat transferring surfaces. Examples of such urging means will be described in the following.

An embodiment of a device according to the invention is characterized in that the heat transferring material comprises a metal which is liquid at the operational temperature. Since metals have a relatively high thermal conductivity, the rate of heat transfer via the additional heat transfer path is further improved.

A further embodiment of a device according to the invention is characterized in that the heat transferring material comprises at least one of the elements Bi, Ga, In, Ka, Li, Na, Pb, Se, or Sn. These metals and alloys thereof have a relatively low melting temperature, so that the additional heat transfer path is already achieved at a relatively low operational temperature of the device, and the operational temperature of the device is limited.

An embodiment of a device according to the invention is characterized in that the chamber is annular and concentric with respect to the axis of rotation. During operation of the device, with the carrier and the first bearing member rotating about the axis of rotation, the liquid heat transferring material will be evenly distributed in the annular chamber, seen in the tangential direction relative to the axis of rotation, under the influence of the centrifugal forces exerted on the liquid material. As a result, seen in said tangential direction, a uniform rate of heat transfer via the additional heat transfer path is achieved, so that the carrier will be evenly cooled.

A further embodiment of a device according to the invention is characterized in that at least a portion of the chamber, where the chamber is at its largest distance from the axis of rotation, is bounded by both heat transferring surfaces. In this embodiment, during operation, with the carrier rotating about the axis of rotation, the liquid heat transferring material is urged under the influence of centrifugal forces towards the portion of the annular chamber where the chamber is at its largest distance from the axis of rotation. Since said portion of the chamber is bounded by both heat transferring surfaces, the liquid material is effectively urged towards said heat transferring surfaces. Accordingly, in this embodiment the urging means for urging the liquid material towards the heat transferring surfaces comprise said chamber and a driving member, by means of which the carrier is rotated about the axis of rotation and, accordingly, the centrifugal forces are generated.

A further embodiment of a device according to the invention is characterized in that the chamber tapers, seen in a radial direction away from the axis of rotation, the heat transferring surfaces constituting tapering walls of the chamber. In this embodiment, during operation, with the carrier rotating about the axis of rotation, the liquid heat transferring material is urged under the influence of centrifugal forces into the tapering portion of the chamber. Since the heat transferring surfaces constitute the tapering walls of the chamber, it is ensured that the liquid material is in contact with both heat transferring surfaces, also in cases where only a relatively small amount of liquid material is present in the chamber.

A further embodiment of a device according to the invention is characterized in that the chamber comprises an annular base portion and a conical portion, which is concentric with the axis of rotation and which connects to the base portion at a location where said conical portion is at its smallest distance from the axis of rotation, the heat transferring surfaces constituting conical walls of said conical portion. In this embodiment, during operation, with the carrier rotating about the axis of rotation, the liquid heat transferring material is urged under the influence of centrifugal forces into said conical portion of the chamber. Since the heat transferring surfaces constitute the conical walls of said conical portion, it is ensured that the liquid material is in contact with both heat transferring surfaces at least in a part of the conical portion where the conical portion is at its largest distance from the axis of rotation.

An embodiment of a device according to the invention is characterized in that the heat transferring material is contained in a flexible envelope. In this embodiment, leakage of the liquid heat transferring material from the chamber to the vacuum space is prevented in that the liquid material is enclosed in said envelope. In this manner, the chamber does not need to be sealed from the vacuum space and can even be partially open relative to the vacuum space. Since the envelope is flexible, a good thermal contact is obtained between said heat transferring surfaces and the envelope when the liquid heat transferring material in the envelope is urged towards the heat transferring surfaces, and the envelope is also able to follow thermal deformations of the heat transferring surfaces. As a result, the thermal contact between the heat transferring surfaces and the liquid heat transferring material in the envelope is hardly affected by the presence of the envelope, provided that the envelope is made from a material which is sufficiently flexible and which has a sufficient thermal conductivity. Like in the embodiments described before, the liquid material in the envelope may be urged towards the heat transferring surfaces under the influence of centrifugal forces. Alternatively, urging means may for example be used comprising a mechanical spring which urges the envelope with the liquid material contained therein towards the heat transferring surfaces.

A further embodiment of a device according to the invention is characterized in that the envelope has a wall thickness between approximately 5 and 100 μm, and is made from a material comprising at least one of the elements Ag, Au, Cu, Ni, Re, Rh, Ta, or W. When the envelope has a wall thickness within the range as mentioned, and is made from a metal as mentioned or from an alloy thereof, the envelope is very flexible and has a very high thermal conductivity. As a result, the thermal contact between the liquid heat transferring material in the envelope and the heat transferring surfaces is substantially not influenced by the presence of the envelope.

Figure 2:
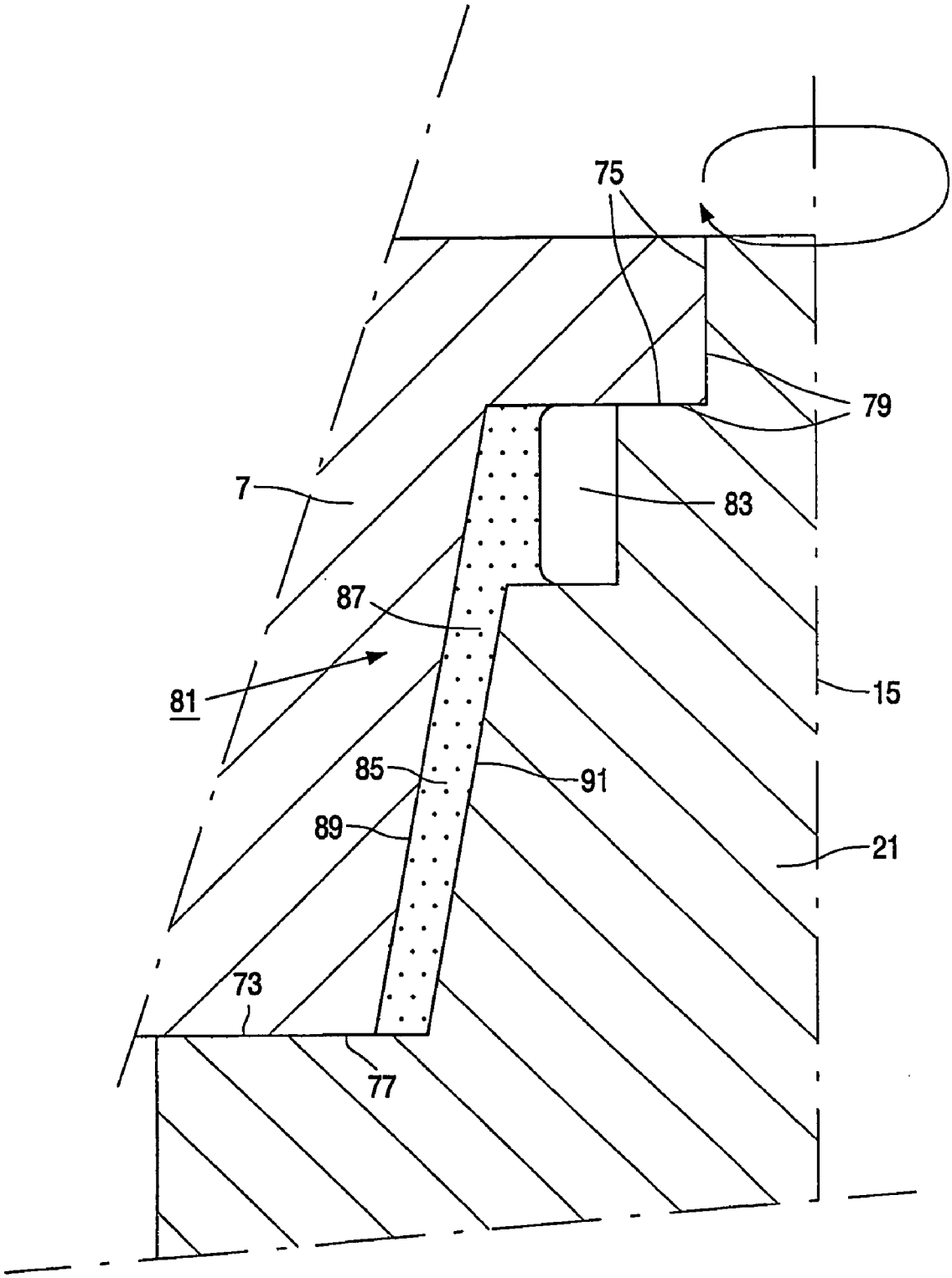
Figure 3:
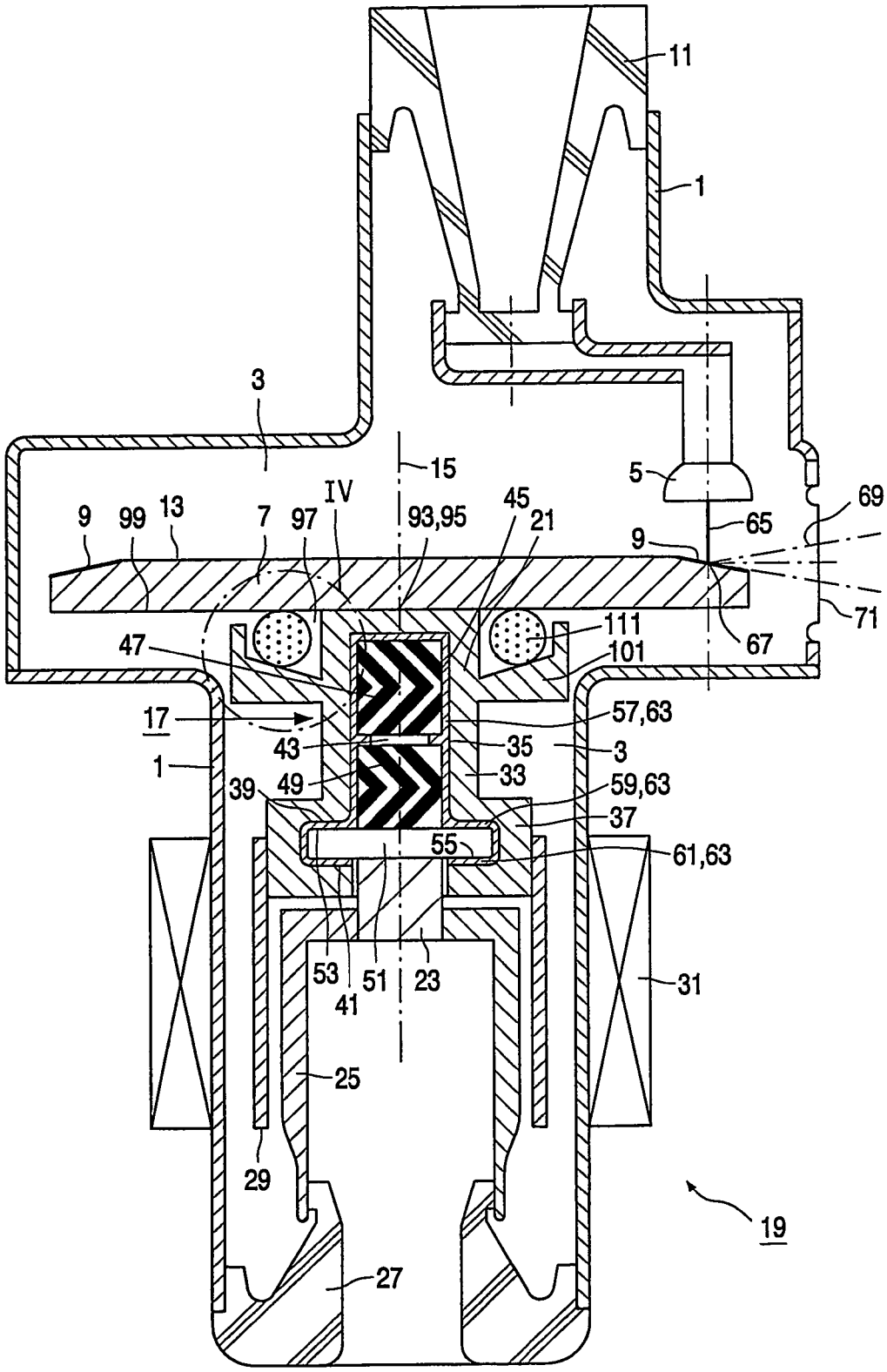

In the following, embodiments of a device for generating X-rays according to the invention will be described in detail as shown in the figures, in which FIG. 1 schematically shows a longitudinal section of a first embodiment of a device for generating X-rays according to the invention, FIG. 2 in detail shows, during operation, a chamber containing a liquid heat transferring material of the device of FIG. 1, FIG. 3 schematically shows a longitudinal section of a second embodiment of a device for generating X-rays according to the invention, FIG. 4 in detail shows, during operation, a chamber containing a liquid heat transferring material of the device of FIG. 3, FIG. 5 in detail shows, during operation, a chamber containing a liquid heat transferring material of a third embodiment of a device for generating X-rays according to the invention, and FIG. 6 in detail shows, during operation, a chamber containing a liquid heat transferring material of a fourth embodiment of a device for generating X-rays according to the invention.

The first embodiment of a device for generating X-rays according to the invention as shown in FIG. 1 comprises a metal housing 1 enclosing a vacuum space 3, in which a source 5 or cathode for emitting electrons and a carrier 7 or anode provided with a material 9 which generates X-rays as a result of the incidence of electrons are present. The source 5, which is only schematically shown in FIG. 1, is mounted to the housing 1 by means of a first mounting member 11 made from an electrically insulating material. The carrier 7 is substantially disc-shaped, and the X-ray generating material 9, e.g. W, is provided in the form of an annular layer on the main side 13 of the carrier 7 facing the source 5. The carrier 7 is made from a material having a relatively high melting point. In the embodiment shown, the carrier 7 is made from Mo. Other suitable materials for the carrier 7 are, for example, W, an alloy containing Mo or W, graphite or a ceramic material such as $BC_4$ or AlN. Also, the carrier 7 may be made in its entirety from the X-ray generating material.

The carrier 7 is rotatable about an axis of rotation 15 which extends perpendicularly to the main side 13. For this purpose, the device comprises a dynamic groove bearing 17, by means of which the carrier 7 is journalled, and an electric motor 19, by means of which the carrier 7 can be driven. The dynamic groove bearing 17 comprises an external bearing member 21, which is mounted to the carrier 7, and an internal bearing member 23, which is mounted to the housing 1 by means of a supporting member 25 and a second mounting member 27 made from an electrically insulating material. The motor 19, which is only schematically shown in FIG. 1, comprises a rotor 29, which is also present in the vacuum space 3 and is mounted to the external bearing member 21, and a stator 31, which is present outside the vacuum space 3 and is mounted to an external surface of the housing 1.

The external bearing member 21 comprises a sleeve-shaped portion 33, which has a circular cylindrical inner surface 35 having a center line coinciding with the axis of rotation 15, and a flange-shaped portion 37, which has two annular inner surfaces 39 and 41 extending perpendicularly to the axis of rotation 15. The internal bearing member 23 comprises a shaft-like portion 43, which has a circular cylindrical outer surface 45 provided with two patterns 47 and 49 of V-shaped grooves, and a disc-shaped portion 51, which has two annular outer surfaces 53 and 55 each with a pattern of V-shaped grooves which are not visible in FIG. 1. A circular cylindrical bearing gap 57 is present between the inner surface 35 of the sleeve-shaped portion 33 and the outer surface 45 of the shaft-like portion 43, and annular bearing gaps 59 and 61, respectively, are present between the inner surface 39 of the flange-shaped portion 37 and the outer surface 53 of the disc-shaped portion 51 and between the inner surface 41 of the flange-shaped portion 37 and the outer surface 55 of the disc-shaped portion 51. The bearing gaps 57, 59, 61 contain a liquid lubricant 63, e.g. a gallium alloy such as GaInSn. During rotation of the dynamic groove bearing 17, a pressure is maintained in the liquid lubricant 63 in the bearing gap 57 as a result of a pumping action of the V-shaped grooves 47, 49 provided on the outer surface 45 of the shaft-like portion 43, which causes bearing forces to be generated in the radial direction. Likewise, a pressure is maintained in the liquid lubricant 63 in the bearing gaps 59 and 61 as a result of a pumping action of the V-shaped grooves provided on the outer surfaces 53 and 55 of the disc-shaped portion 51, which causes bearing forces to be generated in the axial direction. As a further result of said pressure in the liquid lubricant 63, mechanical contact between the external bearing member 21 and the internal bearing member 23 is avoided, so that the dynamic groove bearing 17 has a long service life and causes very little noise.

During operation, the source 5 generates an electron beam 65 which impinges upon the X-ray generating material 9 in an impingement position 67. X-rays 69 generated by the material 9 as a result of the incidence of the electron beam 65 emanate from the vacuum space 3 through a window 71, which is provided in the housing 1 and is made from an X-ray transparent material, e.g. Be. During the generation of the X-rays 69, only a very small portion of the energy of the electron beam 65 is converted to X-ray energy. Most of the energy of the electron beam 65 is converted to heat, which results in a considerable increase of the temperature of the carrier 7, particularly when comparatively high energy levels of the X-rays 69 are generated. To avoid excessive local heating of the carrier 7, the carrier 7 is rotated about the axis of rotation 15 during operation, so that the impingement position 67 follows a circular path relative to the carrier 7 over the annular layer of the X-ray generating material 9. As a result, said heat is evenly distributed along said circular path and over the entire carrier 7.

Since the carrier 7 is present in the vacuum space 3, heat transfer from the carrier 7 to the surroundings of the device or to a cooling unit of the device (not shown in FIG. 1), which heat transfer is necessary to avoid excessive heating of the carrier 7, mainly takes place by heat conduction via the dynamic groove bearing 17, i.e. via the external bearing member 21, the inner surfaces 35, 39, 41 of the external bearing member 21, the liquid lubricant 63 in the bearing gaps 57, 59, 61, the outer surfaces 45, 53, 55 of the internal bearing member 23, and the internal bearing member 23, to the supporting member 25 and the second mounting member 27. Only a comparatively small amount of heat is transferred away from the carrier 7 by heat radiation. The dynamic groove bearing 17 as such has a relatively large heat transfer capacity because the bearing gaps 57, 59, 61 extend over relatively large distances, respectively, in the axial and radial directions. Heat transfer from the carrier 7 to the external bearing member 21 partially takes place via annular mounting surfaces 73, 75 of the carrier 7 and annular mounting surfaces 77, 79 of the external bearing member 21, which are in contact with the mounting surfaces 73, 75 of the carrier 7. Said mounting surfaces 73, 75, 77, 79 are shown in FIG. 2, which shows a detail of the first embodiment at a location referenced II in FIG. 1. However, said mounting surfaces 73, 75, 77, 79 form an interruption of the heat transfer path from the carrier 7 to the dynamic groove bearing 17 and hence limit the overall rate of heat transfer from the carrier 7 to the surroundings of the device. Particularly at relatively high temperatures of the carrier 7, i.e. at relatively high energy levels of the generated X-rays 69, the rate of heat transfer via the mounting surfaces 73, 75, 77, 79 is further limited as a result of the fact that the contact between the mounting surfaces 73, 75 and the mounting surfaces 77, 79 is reduced as a result of thermal deformation of the mounting surfaces 73, 75, 77, 79.

In the first embodiment of the device according to the invention the rate of heat transfer from the carrier 7 to the external bearing member 21 is considerably improved in the following manner. As shown in FIG. 2, the device comprises an annular chamber 81 which is concentric with the axis of rotation 15. In the embodiment shown in FIG. 2, the chamber 81 comprises an annular base portion 83 and a conical portion 85 which are both concentric with the axis of rotation 15, said conical portion 85 connecting to the base portion 83 at a location where said conical portion 85 is at its smallest distance from the axis of rotation 15. The chamber 81 is partially filled with a heat transferring material 87 which is liquid at an operational temperature of the device. In the embodiment shown, the heat transferring material 87 is identical to the liquid lubricant 63 in the dynamic groove bearing 17, i.e. an alloy of Ga, In, and Sn. Instead of said alloy, other materials may be used which are liquid at the operational temperature of the device and which have a comparatively high thermal conductivity. Preferably, the heat transferring material is a metal in view of the high thermal conductivity of metals. Examples of metals having a sufficiently low melting temperature are Bi, Ga, In, Ka, Li, Na, Pb, Se, or Sn, and alloys of these metals. Furthermore, a number of alloys comprising Cu or Ag may be used in view of their sufficiently low melting temperature. During the assembly of the device, the heat transferring material 87 is provided in solid state, for example as an annular body, in the annular base portion 83 of the chamber 81.

During operation, at the operational temperature of the device, with the carrier 7 and the external bearing member 21 rotating about the axis of rotation 15, the heat transferring material 87 is liquid and is urged into the conical portion 85 of the chamber 81, i.e. the portion of the chamber 81 where the chamber 81 is at its largest distance from the axis of rotation 15, under the influence of the centrifugal forces exerted on the liquid material 87. As a result, the liquid material 87 is urged towards, and brought into contact with, the conical walls 89, 91 of said conical portion 85. In this manner, an additional heat transfer path is formed between the carrier 7 and the external bearing member 21 via the conical wall 89 of the carrier 7, the liquid material 87 in the conical portion 85 of the chamber 81, and the conical wall 91 of the external bearing member 21, said conical walls 89, 91 thus forming, respectively, an additional heat transferring surface of the carrier 7 and an additional heat transferring surface of the external bearing member 21 bounding the conical portion 85 of the chamber 81. Said additional heat transfer path is parallel to the heat transfer path which goes via the mounting surfaces 73, 75, 77, 79, so that the overall rate of heat transfer from the carrier 7 to the external bearing member 21, and further to the surroundings of the device via the dynamic groove bearing 17, is considerably increased and the heat transferring capacity of the dynamic groove bearing 17 is better utilized. Since the heat transferring material 87 is liquid and is urged in contact with the conical walls 89 and 91, a good thermal contact between said conical walls 89, 91 and the heat transferring material 87 is achieved. Said thermal contact is not affected when the carrier 7 and the external bearing member 21, and hence the conical walls 89, 91 thermally deform at relatively high temperatures, since the liquid material 87 will maintain in contact with the conical walls 89, 91 under influence of the centrifugal forces and will thus follow the deformations of the conical walls 89, 91. As a result, the relatively high rate of heat transfer via the additional heat transfer path is maintained at high temperatures, and the reduction of the overall rate of heat transfer from the carrier 7 to the external bearing member 21 at high temperatures is limited.

Since the chamber 81 comprises the conical portion 85, and the conical walls 89 and 91 respectively constitute a heat transferring surface of the carrier 7 and a heat transferring surface of the external bearing member 21, it is ensured that during operation, in case only a comparatively small amount of the liquid heat transferring material 87 is provided in the chamber 81, the liquid material 87 is in contact with both heat transferring surfaces at least in a part of the conical portion 85 where the conical portion 85 is at its largest distance from the axis of rotation 15. Since the chamber 81, particularly the conical portion 85, is annular and concentric with the axis of rotation 15, during operation the liquid material 87 will be uniformly distributed in the chamber 81, particularly in the conical portion 85, under the influence of the centrifugal forces. As a result, a uniform rate of heat transfer via the additional heat transfer path is achieved, seen in the tangential direction relative to the axis of rotation 15, so that the carrier 7 will be evenly cooled.

Figure 4:
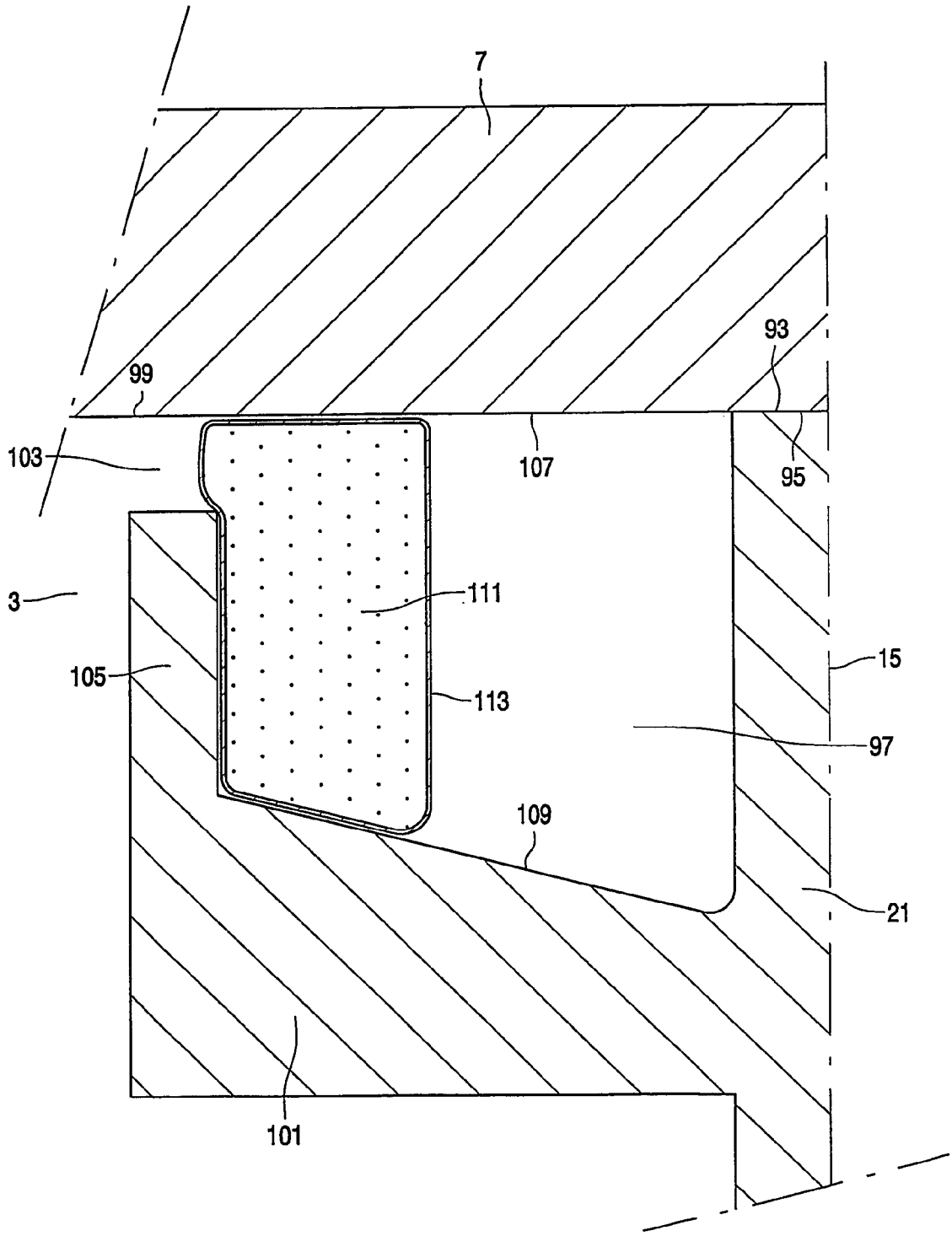

In FIGS. 3 and 4 parts of the second embodiment of the device for generating X-rays according to the invention, which correspond to parts of the first embodiment of the device for generating X-rays as shown in FIGS. 1 and 2, are indicated by means of corresponding reference numbers. In the following, only the main differences between said first and second embodiments will be discussed. In the second embodiment, like in the first embodiment, heat transfer from the carrier 7 to the external bearing member 21 partially takes place via a mounting surface 93 of the carrier 7 and a mounting surface 95 of the external bearing member 21, which is in contact with the mounting surface 93 of the carrier 7. The mounting surfaces 93, 95 are shown in FIG. 4, which shows a detail of the second embodiment at a location referenced IV in FIG. 3. Like the mounting surfaces 73, 75, 77, 79 of the first embodiment, the mounting surfaces 93, 95 of the second embodiment form an interruption of the heat transfer path from the carrier 7 to the dynamic groove bearing 17, particularly at relatively high temperatures of the carrier 7.

The second embodiment of the device for generating X-rays according to the invention mainly differs from the first embodiment in that the second embodiment comprises a different additional heat transfer path between the carrier 7 and the external bearing member 21 to improve the rate of heat transfer from the carrier 7 to the external bearing member 21. As shown in FIG. 4, in the second embodiment the device comprises an annular chamber 97 which is concentric with the axis of rotation 15. The chamber 97 is present between a lower surface 99 of the carrier 7 and an annular, flange-shaped heat transfer body 101, which is in one piece with the external bearing member 21. The chamber 97 is partially open, and hence connected to the vacuum space 3, in that an annular opening 103 is present between said lower surface 99 and a collar 105 of the heat transfer body 101. A portion of said lower surface 99, which bounds the chamber 97, forms a heat transferring surface 107 of the carrier 7, and an inner surface of said heat transfer body 101 forms a heat transferring surface 109 of the external bearing member 21. The chamber 97 tapers, seen in the radial direction away from the axis of rotation 15, said heat transferring surfaces 107 and 109 constituting tapering walls of the chamber 97.

The chamber 97 is partially filled with a heat transferring material 111 which is liquid at an operational temperature of the device. Like in the first embodiment, the heat transferring material 111 is identical to the liquid lubricant 63 in the dynamic groove bearing 17, i.e. an alloy of Ga, In, and Sn. As shown in FIG. 4 the heat transferring material 111 is contained in a flexible envelope 113, so that leakage of the heat transferring material 111, which is liquid during operation, from the chamber 97 to the vacuum space 3 is prevented. In this manner, the chamber 97 does not need to be sealed from the vacuum space 3 by means of, for example, a conventional sealing gasket, which is less reliable when high thermal deformations of the materials surrounding the gasket occur.

During operation, at the operational temperature of the device, with the carrier 7 and the external bearing member 21 rotating about the axis of rotation 15, the heat transferring material 111 is liquid and is urged under the influence of centrifugal forces, and under elastic deformation of the flexible envelope 113, into the portion of the chamber 97 where the chamber 97 is at its largest distance from the axis of rotation 15, i.e. into the tapering portion of the chamber 97 as shown in FIG. 4. Since the heat transferring surface 107 of the carrier 7 and the heat transferring surface 109 of the external bearing member 21 constitute the tapering walls of the chamber 97, it is ensured that the liquid material 111 is urged towards both said heat transferring surfaces 107 and 109. Since the envelope 113 is flexible, a good thermal contact is obtained between the heat transferring surfaces 107, 109 and the envelope 113 under the influence of the fact that the liquid material 111 is urged towards both said heat transferring surfaces 107, 109. In the embodiment shown in FIG. 4, sufficient flexibility and a sufficiently high thermal conductivity of the envelope 113 are obtained in that the envelope 113 is made from Cu and has a wall thickness of approximately 50 μm. It is observed that sufficient flexibility and a sufficiently high thermal conductivity of the envelope 113 can also be obtained if the thickness of the envelope 113 has another value within the range of approximately 5 μm–100 μm and if the envelope 113 is made from a material comprising at least one of the elements Ag, Au, Cu, Ni, Re, Rh, Ta, or W. In such a case, the thermal contact between the heat transferring surfaces 107, 109 and the liquid heat transferring material 111 in the envelope 113 is substantially not influenced by the presence of the envelope 113.

As a result, an additional heat transfer path is formed between the carrier 7 and the external bearing member 21 via the heat transferring surface 107 of the carrier 7, the liquid heat transferring material 111 in the envelope 113, the heat transferring surface 109 of the external bearing member 21, and the heat transfer body 101 of the external bearing member 21. Said additional heat transfer path is parallel to the heat transfer path which goes via the mounting surfaces 93 and 95, so that the overall rate of heat transfer from the carrier 7 to the external bearing member 21, and further to the surroundings of the device via the dynamic groove bearing 17, is considerably increased. The thermal contact between the liquid heat transferring material 111 and the heat transferring surfaces 107, 109 is not affected when the carrier 7 and the external bearing member 21, and hence the heat transferring surfaces 107, 109 thermally deform at relatively high temperatures, because the flexible envelope 113 will follow thermal deformations of the heat transferring surfaces 107, 109 and therefore will remain in good thermal contact with the heat transferring surfaces 107, 109 under the influence of the centrifugal forces exerted on the liquid heat transferring material 111. As a result, the relatively high rate of heat transfer via the additional heat transfer path is maintained at high temperatures, and the reduction of the overall rate of heat transfer from the carrier 7 to the external bearing member 21 at high temperatures is limited.

It is noted that heat transfer by the liquid heat transferring material 111 in the envelope 113 takes place by heat conduction through the liquid material 111. A certain amount of heat transfer, however, also takes place by convection as a result of a flow of the liquid material 111 in the envelope 113.

Figure 5:
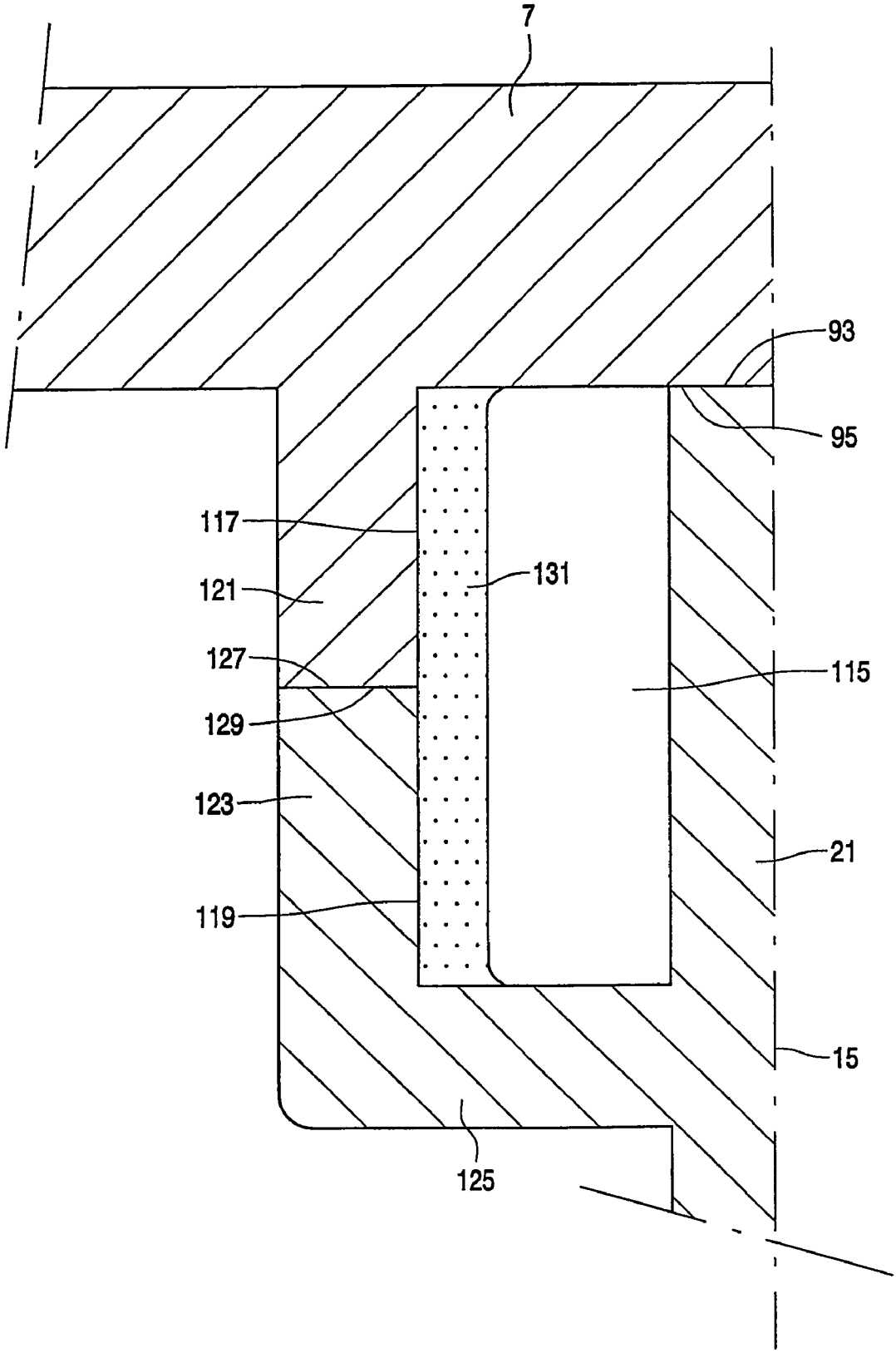
Figure 6:
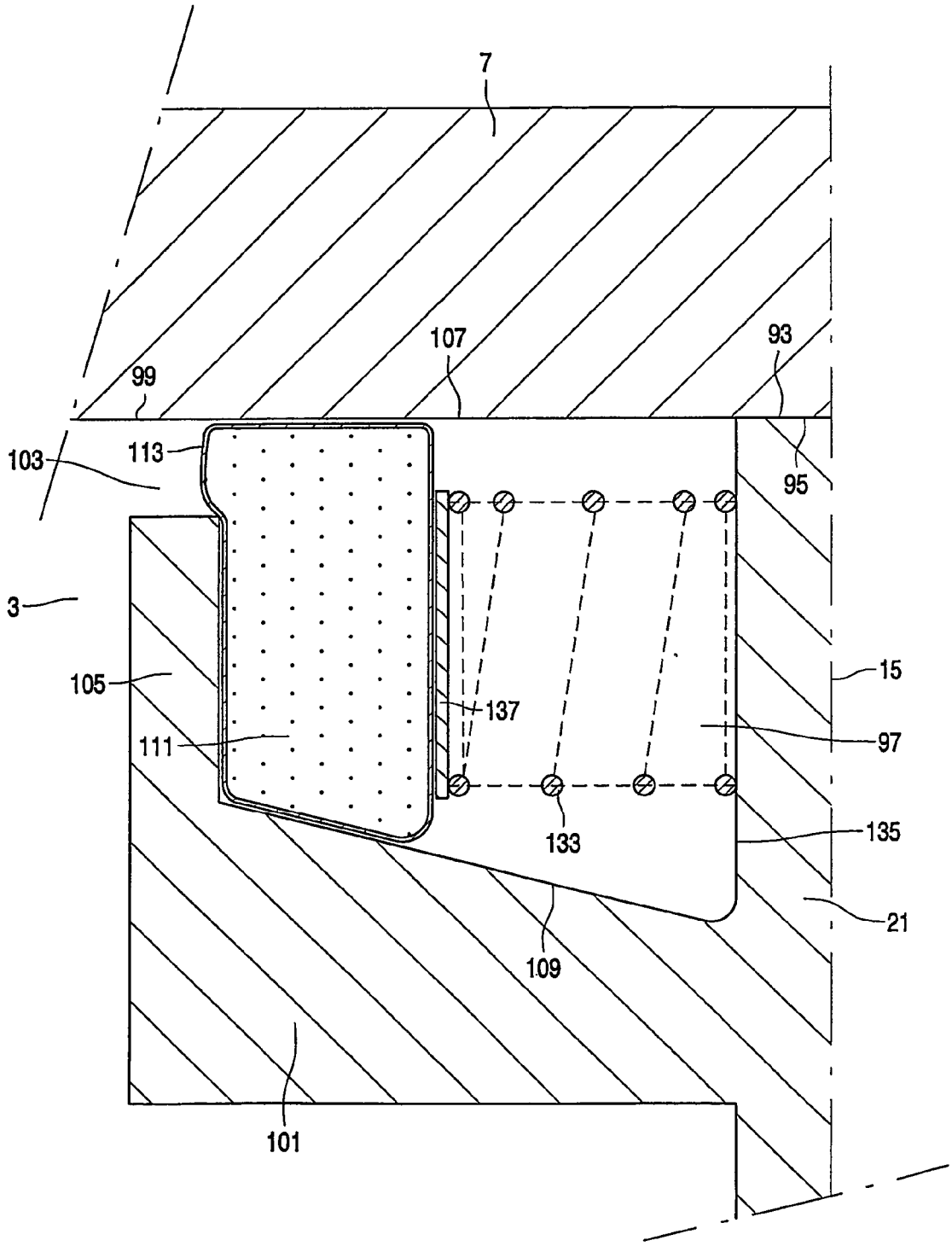

The third embodiment of a device for generating X-rays according to the invention, which is partially shown in detail in FIG. 5, comprises a closed annular chamber 115 of which only a portion, where the chamber 115 is at its largest distance from the axis of rotation 15, is bounded by a heat transferring surface 117 of the carrier 7 and by a heat transferring surface 119 of the external bearing member 21. In this embodiment, the heat transferring surface 117 of the carrier 7 constitutes the inner wall of a first annular heat transfer body 121, which is integral with the carrier 7, and the heat transferring surface 119 of the external bearing member 21 constitutes the inner wall of an annular collar 123 of a second heat transfer body 125, which is integral with the external bearing member 21, said first heat transfer body 121 and said collar 123 of the second heat transfer body 125 having the same diameter and resting against each other at the location of mounting surfaces 127 and 129 between which a suitable sealing gasket is provided. Also in this embodiment, a liquid heat transferring material 131 is present in the chamber 115. Since the heat transferring surfaces 117 and 119 bound the chamber 115 at the location where the chamber 115 is at its largest distance from the axis of rotation 15, it is ensured that, during operation, the liquid material 131 is urged, under the influence of the centrifugal forces, into contact with both heat transferring surfaces 117 and 119.

It is noted that the invention also encloses embodiments in which, during operation, the liquid heat transferring material is urged towards the heat transferring surfaces of the carrier and the external bearing member, not under the influence of centrifugal forces, like in the embodiments described before, but under the influence of alternative urging means. In the fourth embodiment of a device for generating X-rays according to the invention, which is partially shown in detail in FIG. 6 and which is a modification of the second embodiment shown in FIG. 4, the liquid heat transferring material 111 is for example urged towards the heat transferring surfaces 107 and 109 by means of urging means which comprise a plurality of mechanical springs 133 which are mounted at regular intervals around a cylindrical outer wall 135 of the external bearing member 21. Each spring 133 is pretensioned between said outer wall 135 and a pressing plate 137, which is in contact with the flexible envelope 113 containing the liquid material 111. Thus, the material 111 in the envelope 113 is compressed by the pressing plates 137 in radial directions, so that the material 111 is urged under the influence of said compression towards the heat transferring surfaces 107 and 109.

A further alternative urging means for example comprises a flexible envelope, which is filled with a pressurized gas and which is in contact with the liquid heat transferring material to urge the liquid material towards the heat transferring surfaces under the influence of the gas pressure.

It is noted that the invention also comprises embodiments of a device for generating X-rays in which the bearing is not a dynamic groove bearing, like in the embodiments shown in the figures, but in which another kind of bearing is used such as, for example, a conventional ball bearing. It is noted, however, that a dynamic groove bearing is preferred in view of its favorable heat transferring properties.

It is further noted that the invention also comprises embodiments of a device for generating X-rays in which the carrier and the bearing member, to which the carrier is connected, do not constitute separate parts of the device, like in the embodiments shown in the figures, but in which the carrier and said bearing member are integrated into a single part, i.e. made from a single piece of material. It is true that in such an alternative embodiment the rate of heat transfer from the carrier to the bearing is not adversely affected by a separation between the carrier and said bearing member. However, also in this alternative embodiment the additional heat transfer path via the liquid heat transferring material provides a considerable increase in the overall rate of heat transfer from the carrier to the bearing. Therefore, the expression "connected to" in the claims covers both embodiments in which the carrier is mounted to the bearing member by means of suitable mounting means and embodiments in which the carrier and the bearing member form a single part of the device. The carrier may of course also be connected to the internal bearing member, in which case the external bearing member is stationary.

It is further noted that the invention also comprises embodiments of a device for generating X-rays in which the chamber is completely or substantially completely filled with the liquid heat transferring material, as distinct from the embodiments shown in the figures where said chamber is only partially filled with the liquid material.

It is finally noted that the invention also comprises embodiments of a device for generating X-rays in which the chamber containing the liquid heat transferring material has a different shape than the chambers in the embodiments shown in the figures. Instead of a single annular chamber, the device may for example comprise a plurality of relatively small chambers which are arranged at regular interspaces around the axis of rotation.

The invention claimed is:

1. A device for generating X-rays, which device comprises a source for emitting electrons, a carrier which is provided with a material which generates X-rays as a result of the incidence of electrons, and a bearing having an internal bearing member and an external bearing member by means of which the carrier is journalled so as to be rotatable about an axis of rotation, a first one of the bearing members being connected to the carrier, wherein the device comprises a chamber which is bounded by a heat transferring surface of the carrier and by a heat transferring surface of the first bearing member and which is at least partially filled with a heat transferring material, which is liquid at an operational temperature of the device, said liquid material being urged, during operation, towards both said heat transferring surfaces.

2. A device as claimed in claim 1, wherein the heat transferring material comprises a metal which is liquid at the operational temperature.

3. A device as claimed in claim 2, wherein the heat transferring material comprises at least one of the elements selected from the group consisting of Bi, Ga, In, Ka, Li, Na, Pb, Se, and Sn.

4. A device as claimed in claim 1, wherein the chamber is annular and concentric with respect to the axis of rotation.

5. A device as claimed in claim 4, wherein at least a portion of the chamber, where the chamber is at its largest distance from the axis of rotation, is bounded by both heat transferring surfaces.

6. A device as claimed in claim 4, wherein the chamber tapers, seen in a radial direction away from the axis of rotation, the heat transferring surfaces constituting tapering walls of the chamber.

7. A device as claimed in claim 4, wherein the chamber comprises an annular base portion and a conical portion, which is concentric with the axis of rotation and which connects to the base portion at a location where said conical portion is at its smallest distance from the axis of rotation, the heat transferring surfaces constituting conical walls of said conical portion.

8. A device as claimed in claim 1, wherein the heat transferring material is contained in a flexible envelope.

9. A device as claimed in claim 8, wherein the envelope has a wall thickness between approximately 5 and 100 j.sm, and is made from a material comprising at least one of the elements selected from the group consisting of Ag, Au, Cu, Ni, Re, Rh, Ta, and W.

* * * * *